US011761305B2

(12) United States Patent
McCarthy et al.

(10) Patent No.: US 11,761,305 B2
(45) Date of Patent: Sep. 19, 2023

(54) DOWNHOLE DEGRADABLE STAGING TOOL

(71) Applicant: Torsch Inc., Calgary (CA)

(72) Inventors: Matthew McCarthy, Calgary (CA); Steven Taitinger, Calgary (CA)

( * ) Notice: Subject to any disclaimer, the term of this patent is extended or adjusted under 35 U.S.C. 154(b) by 0 days.

(21) Appl. No.: 17/539,995

(22) Filed: Dec. 1, 2021

(65) Prior Publication Data

US 2023/0167711 A1 Jun. 1, 2023

(51) Int. Cl.
*E21B 34/14* (2006.01)

(52) U.S. Cl.
CPC ..... *E21B 34/142* (2020.05); *E21B 2200/04* (2020.05); *E21B 2200/06* (2020.05)

(58) Field of Classification Search
CPC .... E21B 34/14; E21B 34/142; E21B 2200/06; E21B 2200/04
See application file for complete search history.

(56) References Cited

U.S. PATENT DOCUMENTS

| | | | | |
|---|---|---|---|---|
| 2013/0048298 | A1* | 2/2013 | Merron | E21B 34/14 166/373 |
| 2016/0102526 | A1* | 4/2016 | Wind | E21B 34/14 166/373 |
| 2019/0003283 | A1* | 1/2019 | Atkins | E21B 34/10 |
| 2019/0010784 | A1* | 1/2019 | Rozenblit | E21B 33/146 |
| 2021/0189835 | A1* | 6/2021 | Maddux | E21B 34/14 |

* cited by examiner

*Primary Examiner* — Christopher J Sebesta
(74) *Attorney, Agent, or Firm* — Richard D. Okimaw

(57) ABSTRACT

An apparatus for selectively opening a passage through a downhole casing comprises an elongate cylindrical housing defining a central bore therein and having at least one passage extending therethrough between the central bore and an exterior of the housing, the housing being configured to be located in line within a downhole casing, a ball seat slidably located within the central bore so as to be operable to selectively cover or uncover the at least one passage and a sealing sleeve slidably located within the central bore between an open and closed position wherein the sealing sleeve valve covers the at least one passage in the closed position and uncovers the at least one passage in the open position.

13 Claims, 21 Drawing Sheets

DOWNHOLE DEGRADABLE STAGING TOOL

BACKGROUND

1. Technical Field

This disclosure relates generally to downhole tools and in particular to a method and apparatus for selectively opening a passage through a downhole casing.

2. Description of Related Art

In hydrocarbon production, wells frequently include a cemented in place liner within the well bore. Such cement is located between the wellbore wall and the liner after being pumped down the interior of the liner. Due to the long lengths of such wellbores, it is frequently necessary to pass the cement through the liner in stages at varying locations along the wellbore. Accordingly, various methods have been developed to selectively open passages through the liner to permit greater control of such cementing operations.

In particular, one common method is to provide a selectably openable or frangible port through the liner at each desired stage. When that stage is desired to be opened to flow concrete therethrough, a ball or other blocking body is dropped to below that stage to increase the pressure at that stage. The increased pressure will cause the opening to rupture or a sleeve to uncover the port whereupon the concrete flowing down the interior of the liner is then passed through the port into the annulus between the liner and the wellbore. After that stage has been completed, the ball may be milled out of the liner.

Such methods commonly suffer from several difficulties. In particular, the ball for opening such a stage is typically located a distance downstream of the opening through the liner. This permits a quantity of concrete to form above the ball that is not moving and therefore subject to curing in place. The pressure within this region may also increase substantially due to such accumulation resulting in some concrete flowing past the ball into the region below the stage which is undesirable. Furthermore, it will be appreciated that the process to mill or bore out the ball after the stage or multiple stages have been completed is time consuming and difficult.

SUMMARY OF THE DISCLOSURE

According to a first embodiment, there is disclosed an apparatus for selectively opening a passage through a downhole casing comprising an elongate cylindrical housing defining a central bore therein and having at least one passage extending therethrough between the central bore and an exterior of the housing, the housing being configured to be located in line within a downhole casing, a ball seat slidably located within the central bore so as to be operable to selectively cover or uncover the at least one passage and a sealing sleeve slidably located within the central bore between an open and closed position wherein the sealing sleeve valve covers the at least one passage in the closed position and uncovers the at least one passage in the open position.

The apparatus may further comprise an intermediate sleeve adapted to cover the at least one passage at a run in configuration. The open position of the sealing sleeve may be upstream of the closed position.

The sealing sleeve may include at least one collet arm extending upwardly therefrom, the at least one collet arm. The ball seat may be connected to and operable to displace the release sleeve.

The sealing sleeve may include a shoulder adapted to receive a dart thereon. Displacement of the sealing sleeve with the dart moves the sealing sleeve from the open position to the closed position.

The ball seat may be slidable to uncover a transfer passage through the sealing sleeve. The apparatus may further comprise a release sleeve adapted to retain the sealing sleeve at an open position.

The release sleeve includes a shoulder adapted to receive a dart thereon. Displacement of the release sleeve disengages at least one collet arm on the sealing sleeve permitting movement of the sealing sleeve from the open position to the closed position. The ball, ball seat and dart may be formed of a dissolvable material.

Other aspects and features of the present disclosure will become apparent to those ordinarily skilled in the art upon review of the following description of specific embodiments in conjunction with the accompanying figures.

BRIEF DESCRIPTION OF THE DRAWINGS

The accompanying drawings constitute part of the disclosure. Each drawing illustrates exemplary aspects wherein similar characters of reference denote corresponding parts in each view.

DETAILED DESCRIPTION

Figure 1:
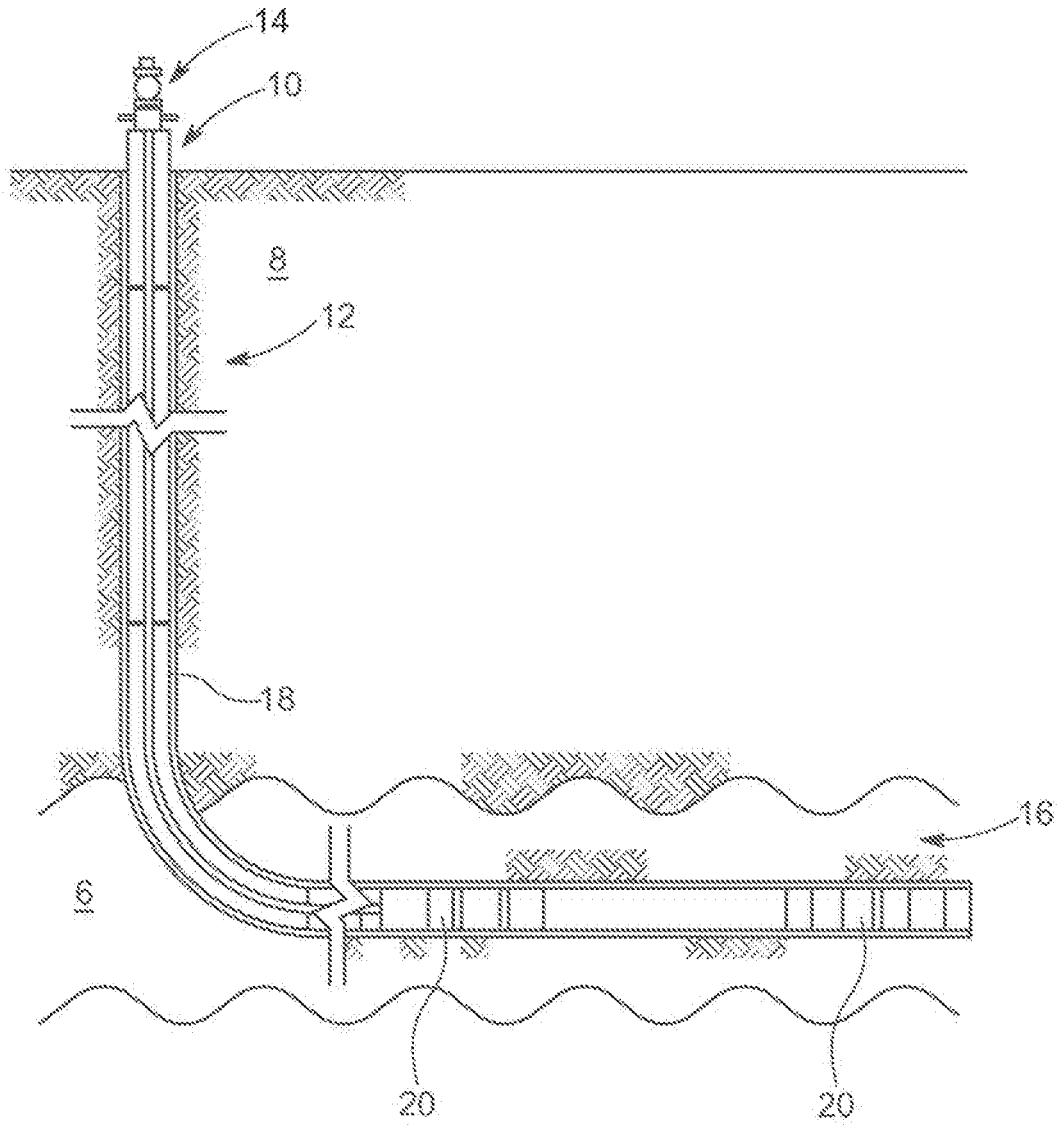
FIG. 1 is an illustration of a hydrocarbon well having at least one degradable staging tool therein.
Figure 2:
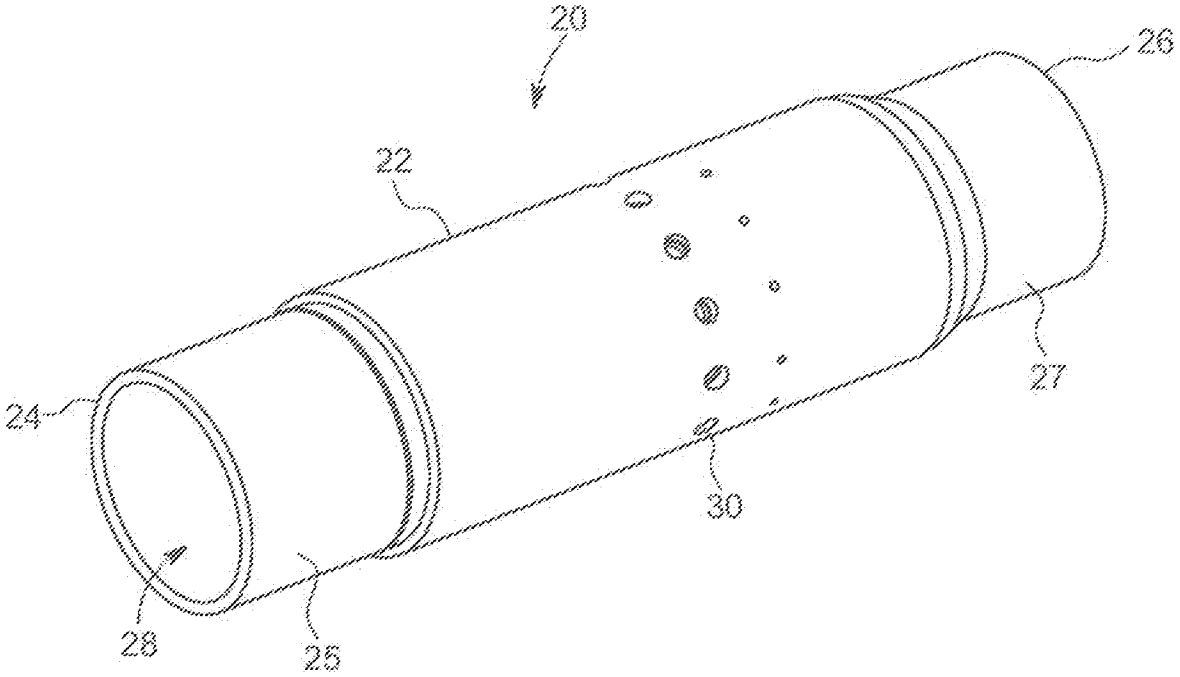
FIG. 2 is a perspective view of a staging tool for use in the hydrocarbon well of FIG. 1.

Aspects of the present disclosure are now described with reference to exemplary apparatuses, methods and systems. Referring to FIG. 1, a wellbore 10 is drilled into the ground to a production zone by known methods. The production zone may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore may include a vertical section 12 and a bottom or production section 14 which may be horizontal or angularly oriented relative to the horizontal located within the production zone 6. Optionally, a casing 18 may be located within the wellbore as are commonly known. As utilized herein, all references to the wellbore in which the present apparatus and tool are pumped down shall be taken to mean both the wellbore formed in the surrounding rock as well as the passage formed by the casing as located within the rock wellbore. In order to pass concrete or other products into the annulus between the casing 18 and the wellbore, they are frequently passed through the casing. As illustrated in FIG. 1, an exemplary apparatus for forming selectably openable passages through the casing according to a first embodiment is generally indicated at 20 in line within the casing 18.

With reference to FIGS. 3-6, the apparatus 20 comprises an outer casing 22 extending between first and second ends, 24 and 26, respectively and having a central bore 28 extending therethrough between the first and second ends. The outer casing 22 includes radial bores 30 extending therethrough and may optionally include first and second end subs, 25 and 27, respectively at the first and second ends for connection sections of casing 18. The casing includes a shifting sleeve 40 having an associated ball seat 60 thereon which is slidably displaceable within the central bore 28. The shifting sleeve 40 includes openings 46 therethrough adapted to be selectably aligned with the radial bores 30 in the outer casing 22 when the shifting sleeve is displaced to a downward position. As illustrated, the shifting sleeve 40 may include a wider portion 48 proximate to the second end 44 and a narrower portion 50 proximate to the first end. The narrow portion 50 is sized to be received within an annular pocket 52 formed between the outer casing 22 and a sealing sleeve 70 as will be more fully described below. The openings 46 may pass through the narrow portion 50 so as to prevent fouling or any material entering such passages during run in operations. The shifting sleeve 40 may be secured to the outer casing with one or more shear pings 54 sized to be sheared at a predetermined pressure.

The apparatus further includes a ball seat 60 secured within the shifting sleeve 40. The ball seat may be sealably secured within the shifting sleeve 40 and includes a ball seat surface 62 oriented towards the first end 24 of the apparatus. The ball seat surface 62 may have a radius selected to correspond to a ball 66 intended to be dropped thereonto.

The apparatus 20 further includes a sealing sleeve 70 located concentrically within the narrow portion 50 of the shifting sleeve 40 so as to contain the narrow portion 50 between the sealing sleeve 70 and the outer casing 22. The sealing sleeve 70 extends between first and second ends, 72 and 74, respectively and may be secured to the outer casing with at least one shear pin 77. The sealing sleeve 70 includes an annular shoulder 76 extending radially into a passage through the sealing sleeve 70. The annular shoulder may be formed of a separate ring secured to the interior bore of the sealing sleeve or may optionally be co-formed therewith.

The apparatus 20 may be provided with a ball 66 as set out above having a radius corresponding to the ball seat surface 62 and an optional closing dart 80. The closing dart 80 comprises a cylindrical body having a size selected to fit within the central bore 28 and within the central passage of the sealing sleeve 70. The dart 80 may optionally include a wiping seal 82 therearound adapted to seal the gap between the dart and the central bore 28. The dart 80 extends between top and bottom ends, 84 and 86, respectively wherein the bottom end includes a profile shaped to correspond to the profile of the ball seat 60 with a ball 66 therein. In particular, the bottom end 86 includes a central spherical recess 88 having a radius similar to the radius of the ball 6 and a conical portion 90 therearound corresponding to the angle of top surface of the ball seat. In such a manner, the dart will closely engage upon the ball seat 60 and ball 6 at as further set out below to minimize locations for concrete or other materials to collect. The dart 80 includes an annular ridge 92 extending therearound having a shoulder engaging surface 94 adapted to be received upon and engage with the annular shoulder 76 of the sliding sleeve.

Figure 3:
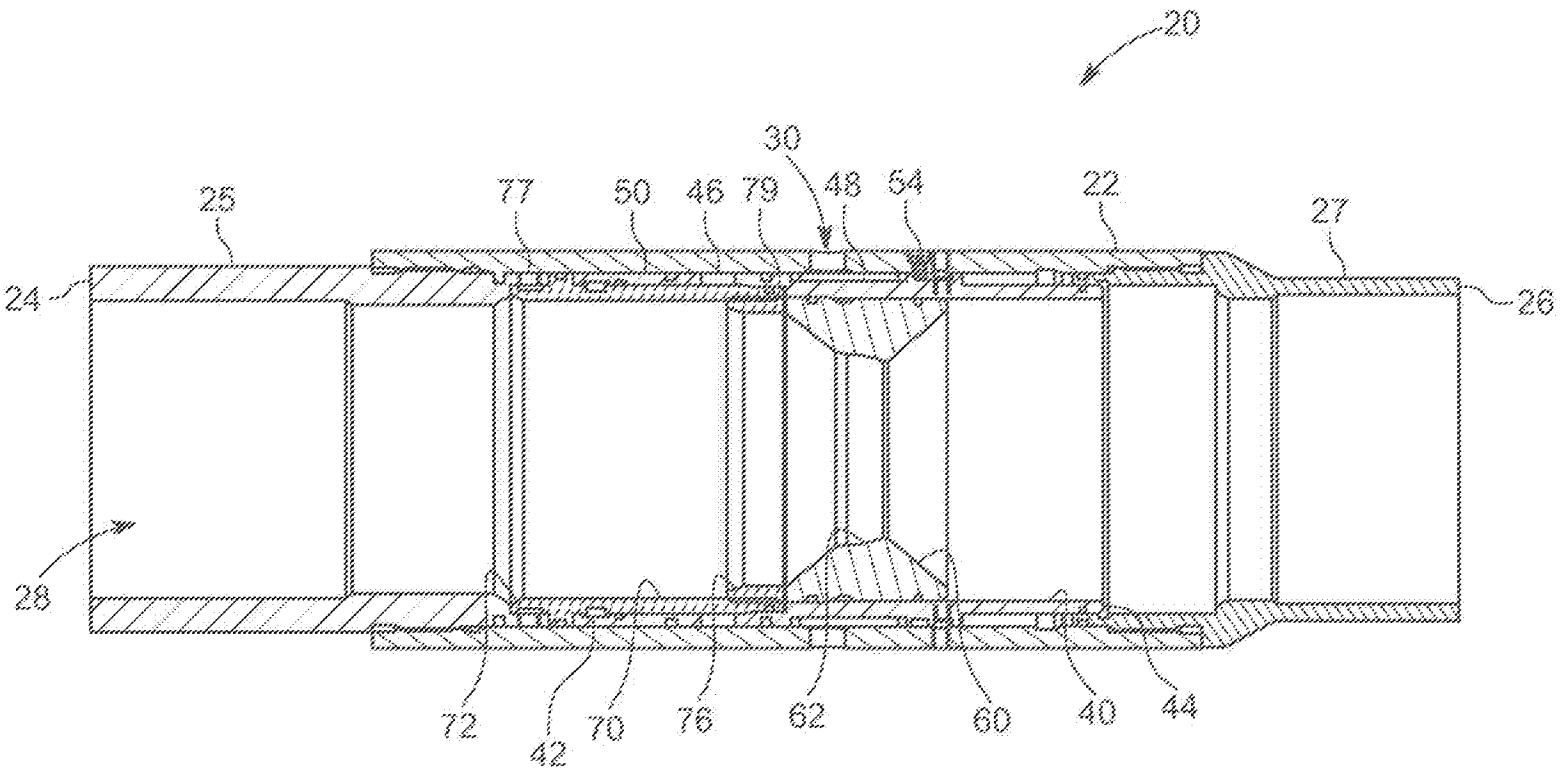
FIG. 3 is a cross sectional view of the staging tool of FIG. 2 at a first or run in configuration.
Figure 4:
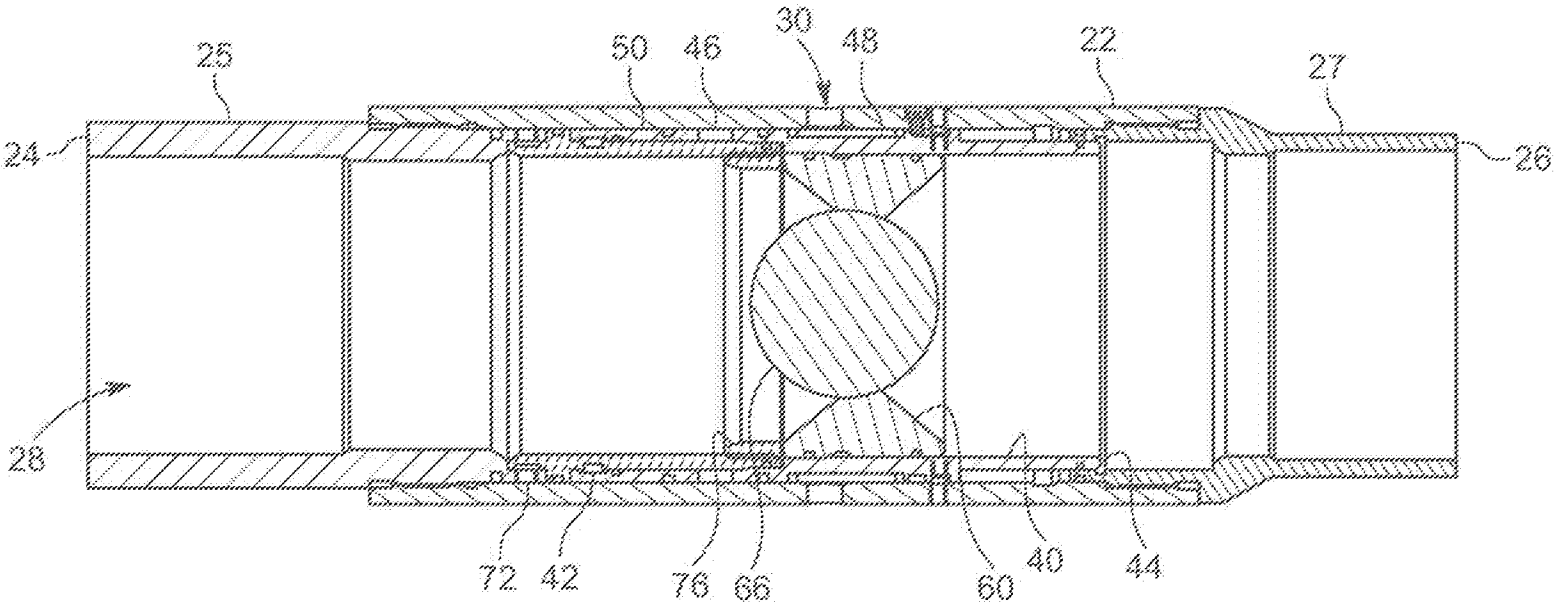
FIG. 4 is a cross sectional view of the staging tool of FIG. 2 with a ball dropped onto the seat thereof.
Figure 5:
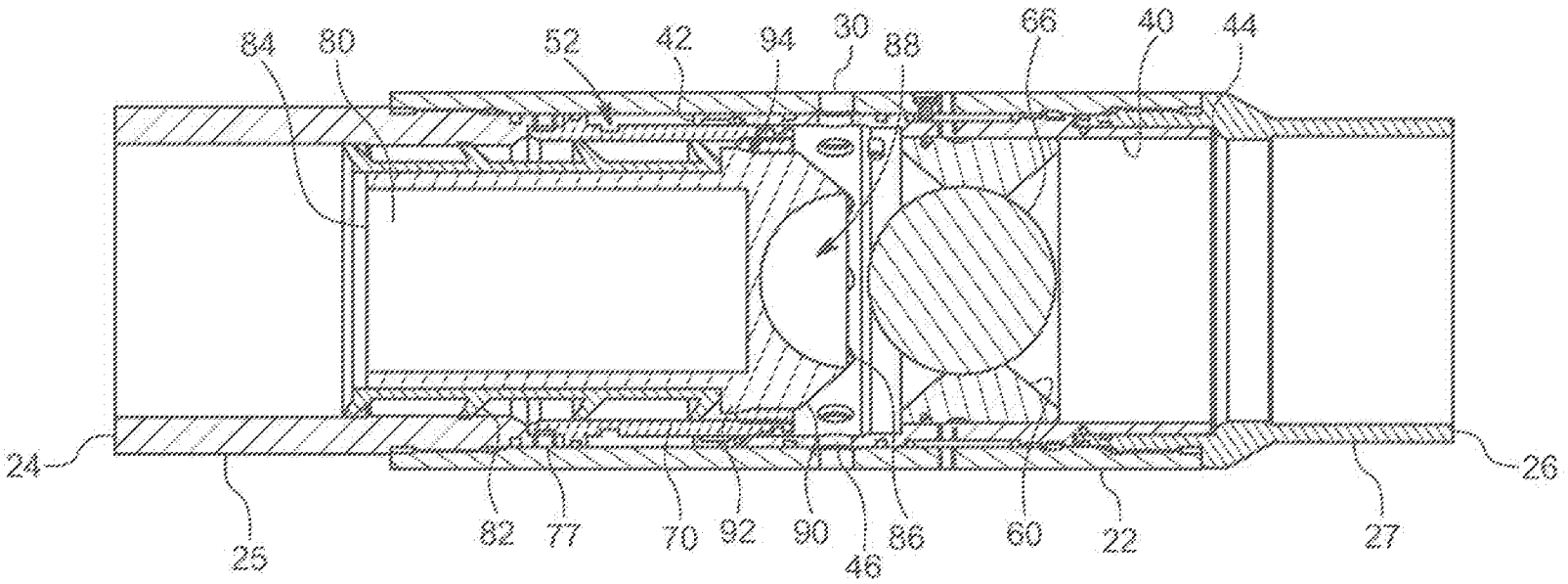
FIG. 5 is a cross sectional view of the staging tool of FIG. 2 at a second or open configuration.

In operation, the apparatus 20 may be located inline within a casing 18 at one or more locations in the wellbore. As illustrated in FIG. 3, at the first or run-in position, both the shifting sleeve 40 and the sealing sleeve are retracted towards the first end 24 of the apparatus 20 and retained in such position by shear pins 54 and 77. Furthermore, as illustrated in FIG. 3, at the first position, the openings 46 of the shifting sleeve 40 are misaligned with the radial bores 28 such that the interior of the casing is isolated from the annulus. When the openings is desired to be opened, such as to pass concrete from the interior of the casing 18 into the annulus, a ball 66 is dropped onto the ball seat thereby sealing the central bore 28 at that location as illustrated in FIG. 4. Thereafter the pressure is increased within the central bore above the pressure required to rupture the shear pins 54 thereby permitting the shifting sleeve 40 to move in a direction towards the second end 26 of the apparatus as illustrated in FIG. 5. This first shear pressure will vary depending upon the size and intended purpose of the apparatus but, by way of non-limiting example, may be selected to be between 1000 and 5000 psi. At the downward or second position as illustrated in FIG. 4, the openings 46 are then aligned with the radial bores 30 so as to permit the flow of concrete or other material from an the interior bore 28 into the annulus between the casing 18 and the wellbore wall.

Figure 6:
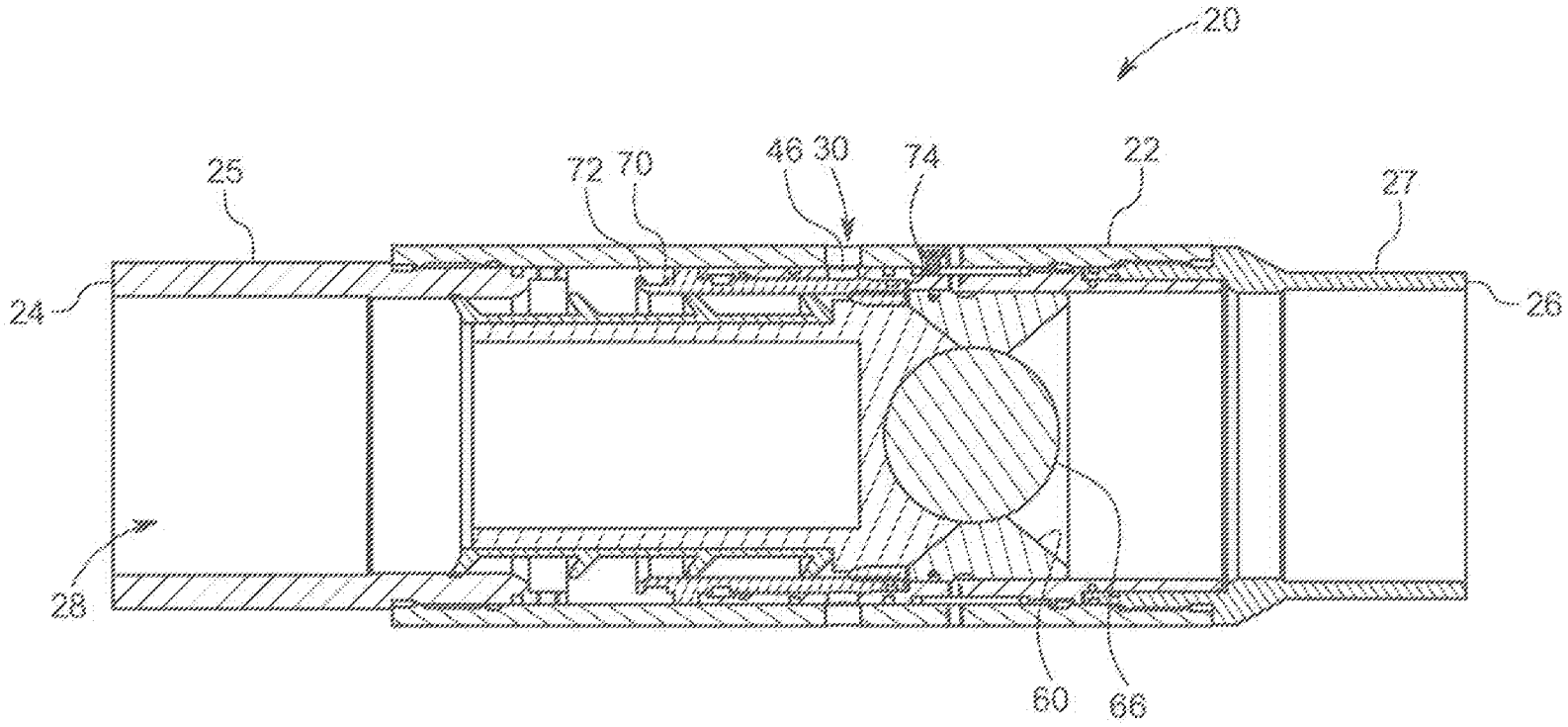
FIG. 6 is a cross sectional view of the staging tool of FIG. 2 at a third or closed configuration.

Once concrete pumping has completed, the dart 80 may be pumped down the interior bore 28 until the shoulder engaging surface 94 of the dart 80 engaged upon the annular shoulder 76 of the shifting sleeve. Thereafter, the pressure within the central passage 28 may again be raised until a sufficient pressure is achieved to shear the shear pins 77 thereby releasing the sealing sleeve 70. The sealing sleeve 70 and the dart 80 then shift towards the second end 26 of the apparatus 20 until the spherical recess 88 surrounds the ball as illustrated in FIG. 6. At such position, the close matching of the shape of the second end 86 of the dart 80 with the ball seat 60 and ball 66 ensures that a minimal amount of concrete remains therebetween while any extra concrete is pushed out through the openings 46 and 30. It will also be observed that at the position illustrated in FIG. 6, the sealing sleeve 70 covers the openings 46 and 30 thereby sealing the central passage 28 from the well annulus.

Once the apparatus 20 has been resealed by the dart and sealing sleeve 70 the dart 80, wiper 82, ball seat 60 and ball 66 may be removed from the central passage 28 by any known means. In particular, known techniques such as milling may be utilized. It has been found to be particularly useful to form the ball 66, ball seat 60, dart 80 and wiper 82 from a dissolvable material so as to permit the pumping of a dissolving agent down the central passage 28 to dissolve the components thereby opening the central passage for production or other operations. Such dissolvable materials may include dissolvable magnesium alloys, dissolvable aluminium alloys, Parker A96 or PGA polymer by way of non-limiting example.

Figure 7:
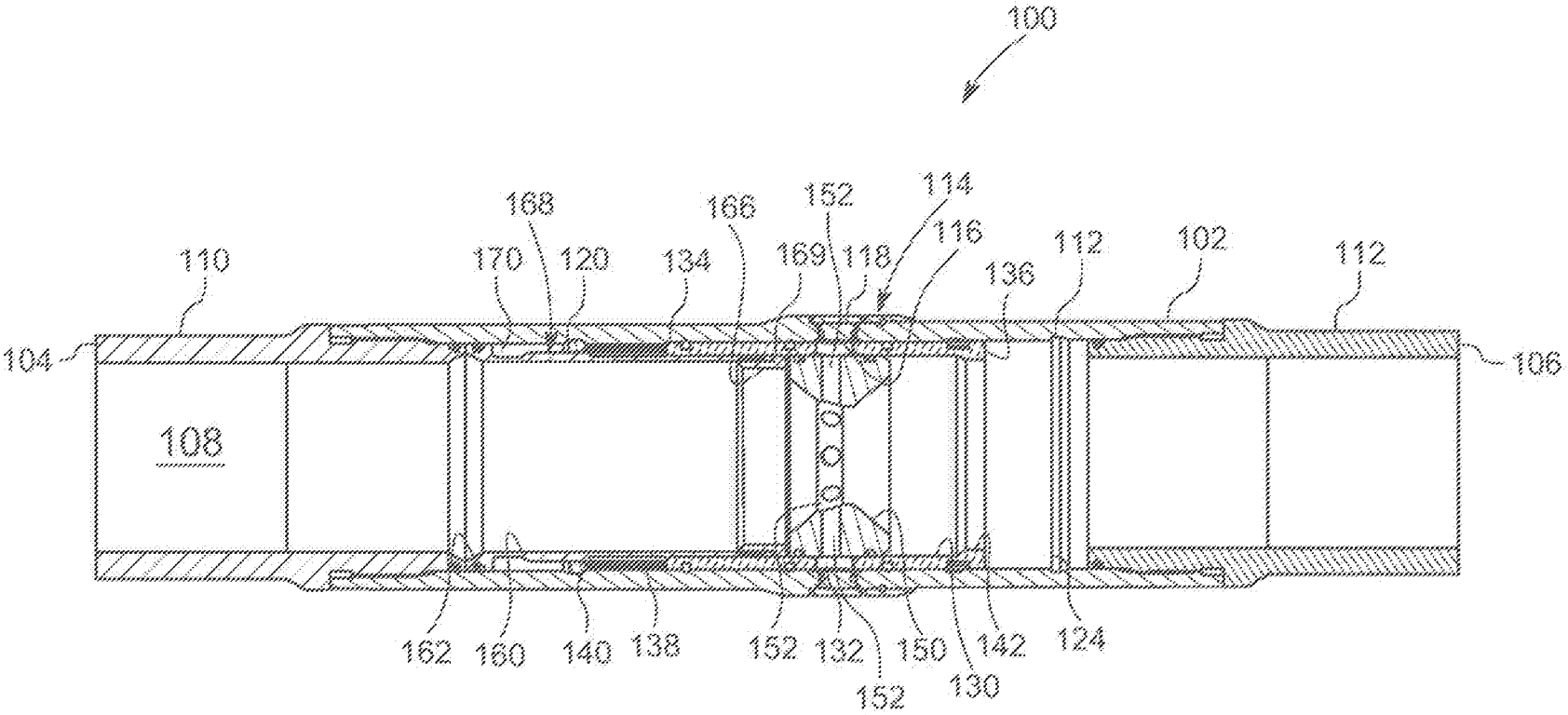
FIG. 7 is a cross sectional view of a staging tool for use in the hydrocarbon well of FIG. 1 according to a further embodiment of the present disclosure at a first or run in configuration.

Turning now to FIGS. 7 through 13, an alternative embodiment of the present apparatus is illustrated generally at 100. The apparatus comprises an outer casing 102 extending between first and second ends, 104 and 106, respectively and having a central bore 108 extending therethrough between the first and second ends. The outer casing 102 may optionally include first and second end subs, 110 and 112, respectively at the first and second ends for connection sections of casing 102. The outer casing 102 includes radial bores 114 extending therethrough which may optionally be covered by plugs 116 and/or a retaining band 118 therearound. As illustrated in FIG. 7, the interior wall of the outer casing 102 includes a release recess 120 at a location towards the first end 104 from the radial bores 114 and a retaining recess 122 towards the second end 106. The release recess may have an angled entrance towards the radial bores 114 whereas the retaining recess 122 includes a radially oriented surface 124 the purpose of which will be more fully described below.

The casing includes a shifting sleeve 130 which is slidably displaceable within the central bore 108 having ball seat 150 slidably located within the shifting sleeve 130. The shifting sleeve 130 includes openings 132 therethrough adapted to be aligned with the radial bores 114 at the initial or run in position and selectably misaligned with the radial bores 114 in the outer casing 102 when the shifting sleeve is displaced to a downward position as will be more fully described below. The shifting sleeve 130 extends between first and second ends 134 and 136, respectively wherein the first end 134 includes at least one flexible collet arm 138 extending longitudinally therefrom. Each collet arm 138 includes a widened portion 140 at a distal end thereof positioned to be received within the release recess 120 at the initial or run in position as illustrated in FIG. 7.

The ball seat 150 is slidably located within the shifting sleeve 130. As illustrated In FIG. 7, the interior profile of the shifting sleeve may include a lip or raised portion 142 so as to prevent movement of the ball seat 150 out of the bottom of the shifting sleeve 130. The ball seat 150 includes a ball seat surface 152 oriented towards the first end 104 of the apparatus with a plurality of bores 154 extending therethrough in radial alignment with the openings 132 in the shifting sleeve 130 such that the ball seat surface 152 surrounds the bores 154. As set out above, the ball seat surface 154 may have a radius selected to correspond to a ball 66 intended to be dropped thereonto. The openings 154 may have a radius smaller than the openings 132 so as to provide a lower flow rate when both openings are in operation. The interior passage 108 of the apparatus further includes a release sleeve 160 extending between first and second ends 162 and 164, respectively. The second end 164 includes an annular shoulder 166 which may be formed of a separate ring secured to the interior bore of the sealing sleeve or may optionally be co-formed therewith. The exterior surface 168 of the release sleeve 160 has a diameter selected to bear against the widened portion 140 of the collet arms 138 so as to retain them within the release recesses 120. Proximate to the first end 160 of the release sleeve, the exterior surface 168 includes a radial recess 170 such that when the recess sleeve is slidably displaced towards the second end 106, the widened portion 48 of the collet arms 138 will be permitted to flex radially inward thereby releasing from the release recess 120 and permitting the shifting sleeve 130 to move towards the second end 106.

Figure 8:
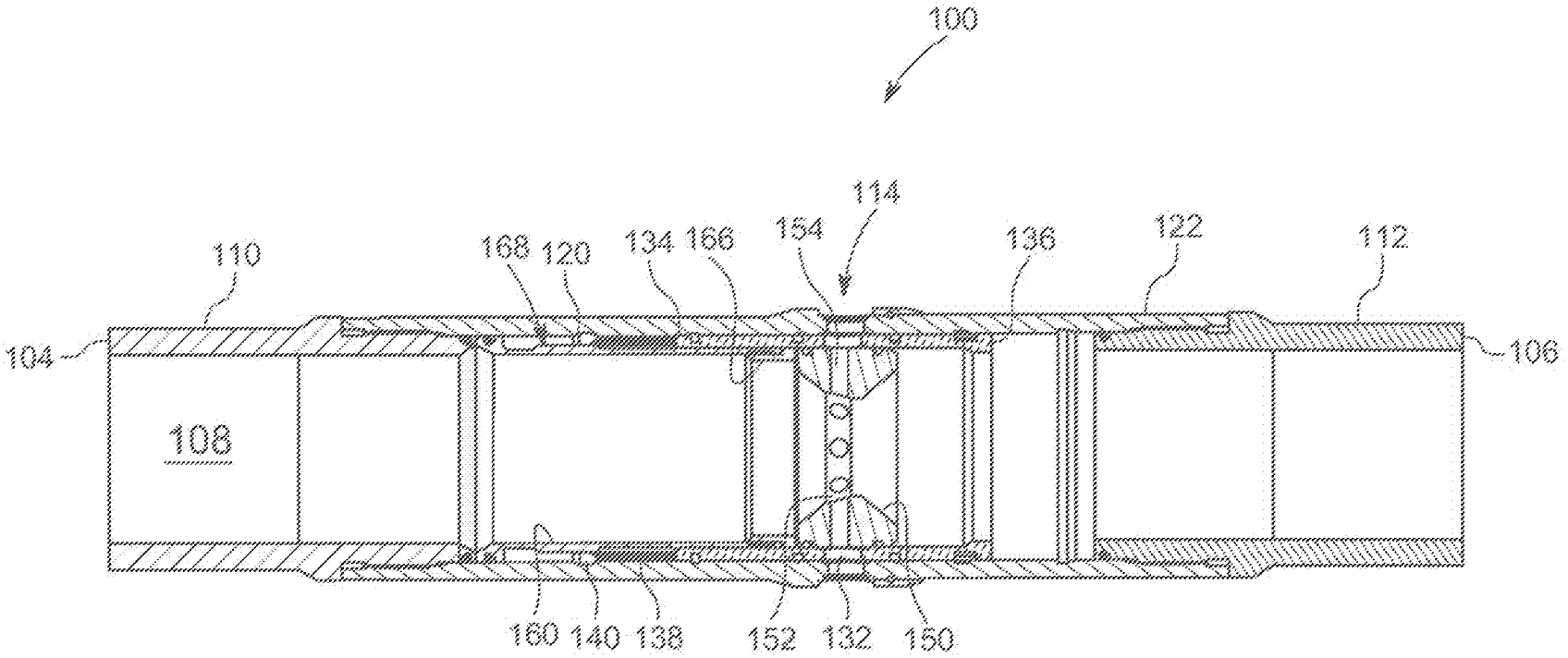
FIG. 8 is a cross sectional view of the staging tool of FIG. 7 at a second or open configuration.

In operation, the apparatus 100 is located inline with the casing 18 and inserted into the wellbore. At the run in position as illustrated in FIG. 7, the shifting sleeve 130, release sleeve 160 and ball seat 150 are all at a position towards the first end 104 of the apparatus wherein the widened portions 140 of the collet arms 138 are retained within the release recess 120 by the exterior surface 168 of the release sleeve 160. When an operator wishes to open that particular zone, a ball (not shown) may be dropped through the apparatus to seal off the casing after which the pressure may be increased within the interior passage 108. The pressure is then increased to a predetermined level selected to rupture or displace the retaining band 118 and/or plugs 116 and thereby open the radial bores 114 as illustrated in FIG. 8. Fluid from inside the interior passage 108 may then be permitted to flow through the openings 154, 132 and 114 to the annulus of the wellbore. The opening 154 may be selected to be smaller than the other passages so as to provide a throttling to the fluid permitted to flow therethrough at this position.

Figure 9:
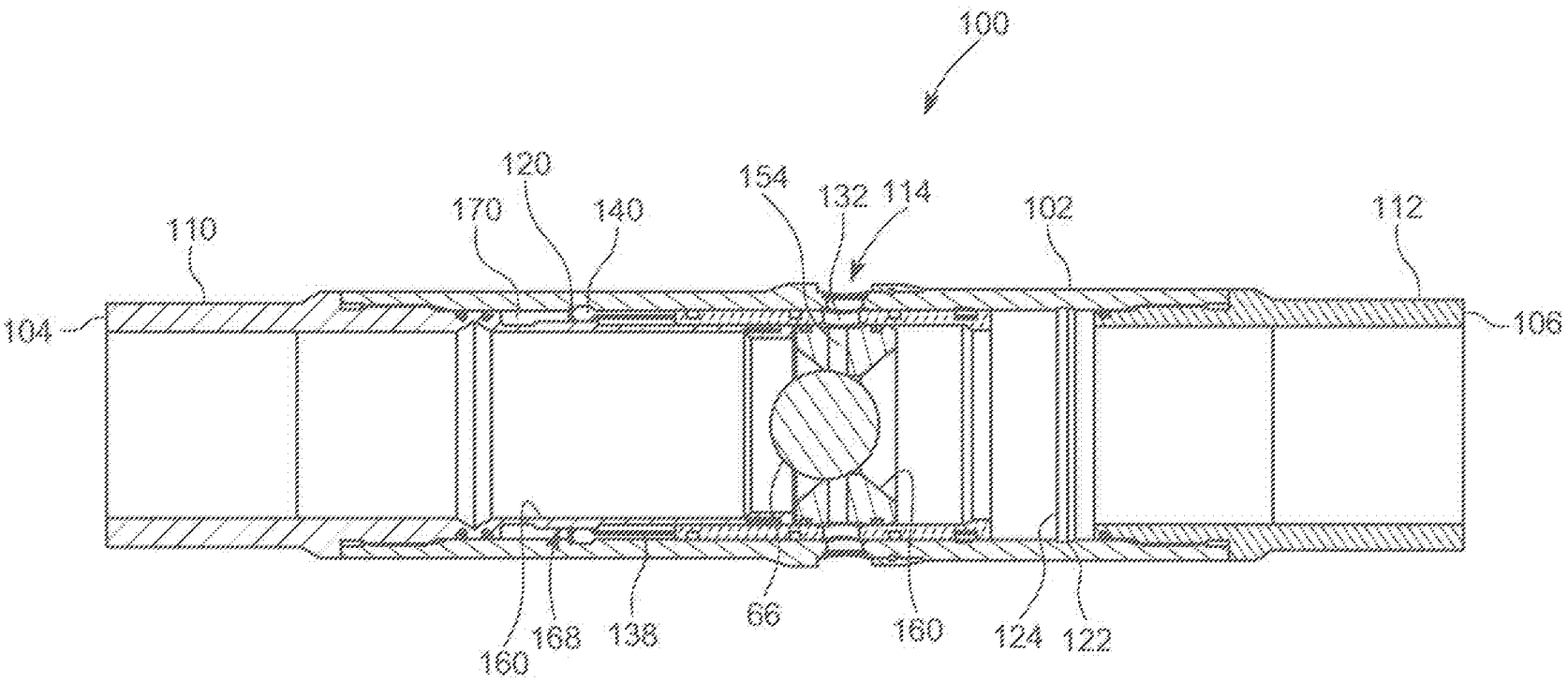
FIG. 9 is a cross sectional view of the staging tool of FIG. 7 with a ball dropped onto the seat thereof.
Figure 10:
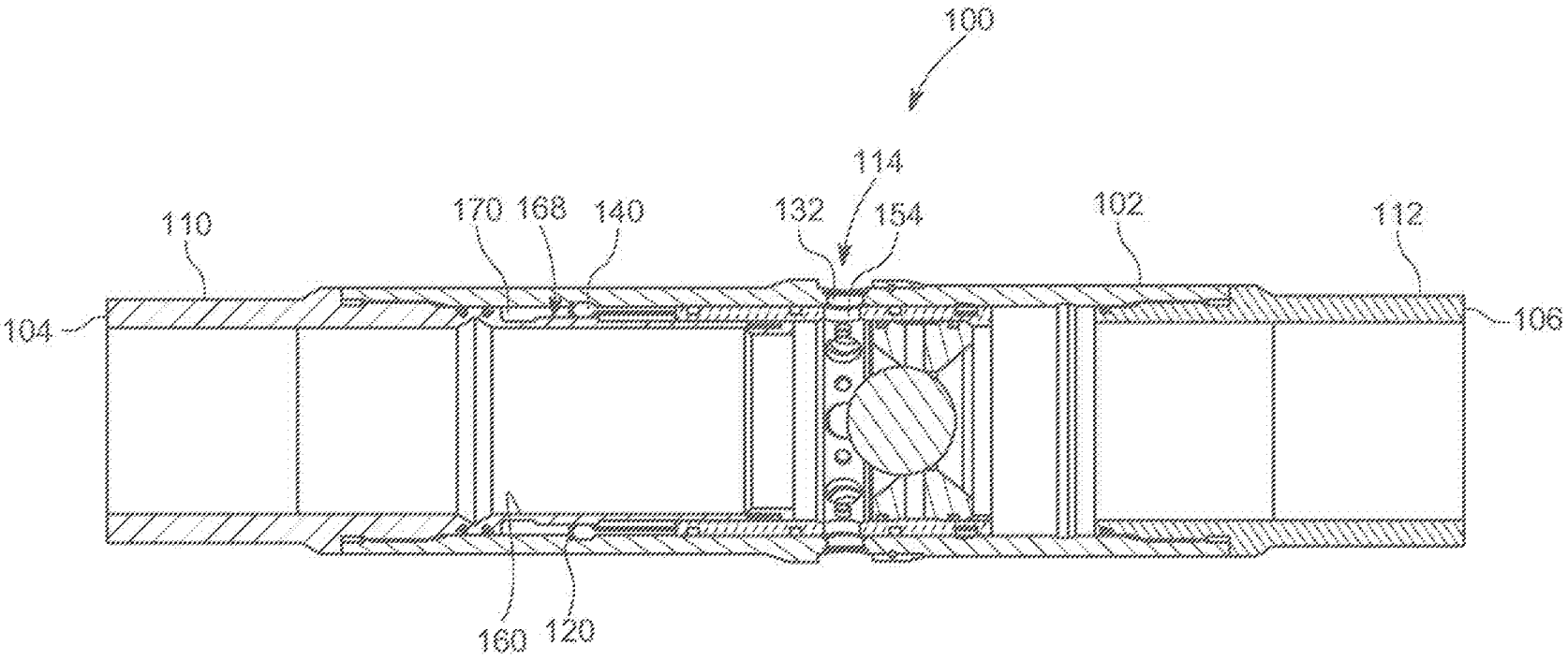
FIG. 10 is a cross sectional view of the staging tool of FIG. 7 at a second or open position.
Figure 11:
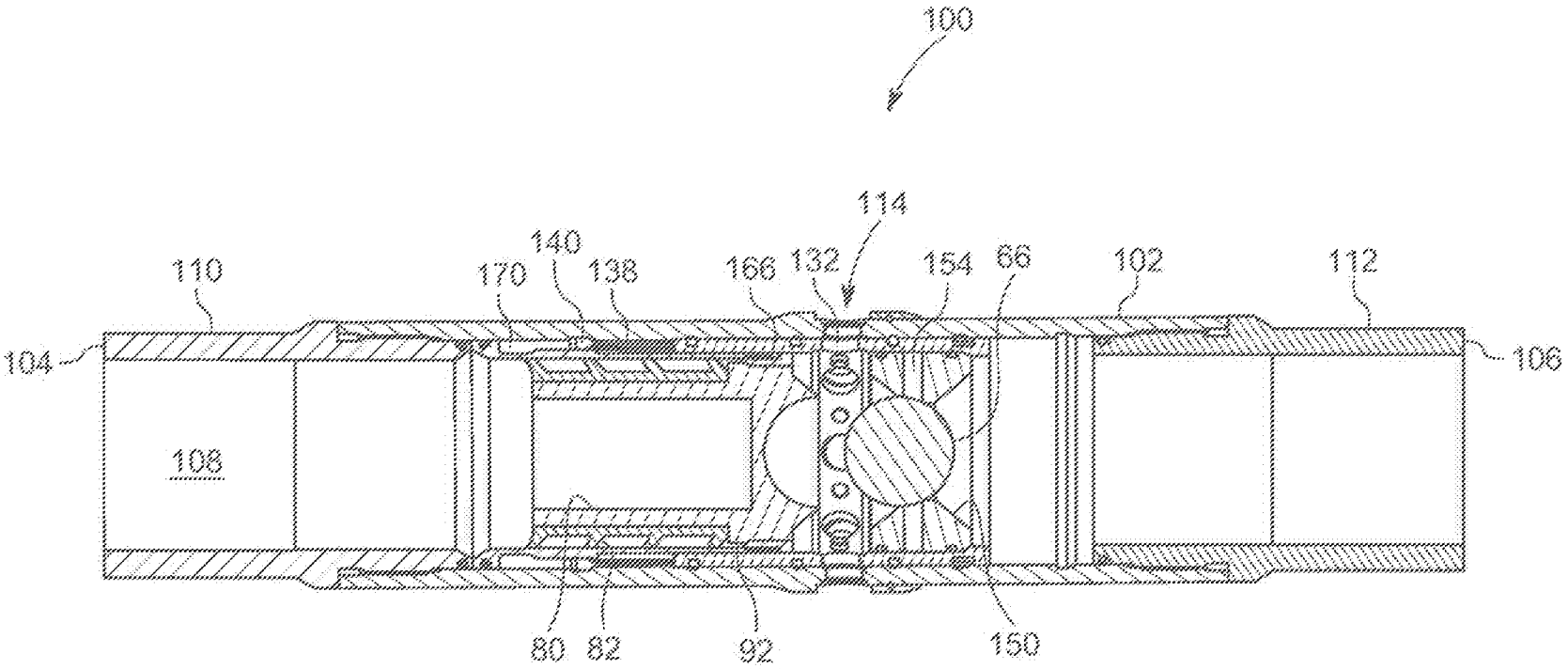
FIG. 11 is a cross sectional view of the staging tool of FIG. 7 with a dart dropped on to the release sleeve.

After opening the radial bores 114, a ball 66 may be dropped onto the ball seat surface 154 as illustrated in FIG. 9. This will then close the openings 154 as well as seal the interior passage 108 at that location. Further pressure increase within the interior passage 108 will then cause the ball 66 and ball seat 150 to shift towards the second end 106 thereby uncovering the openings 132 in the shifting sleeve 130 which are in alignment with the radial bores 114 permitting a fluid such as concrete to flow therethrough. At such position, the ball seat 150 will be only below the openings 132 so as to uncover them thereby limiting any amount of concrete which could accumulate and potentially leak past the ball 66.

Figure 12:
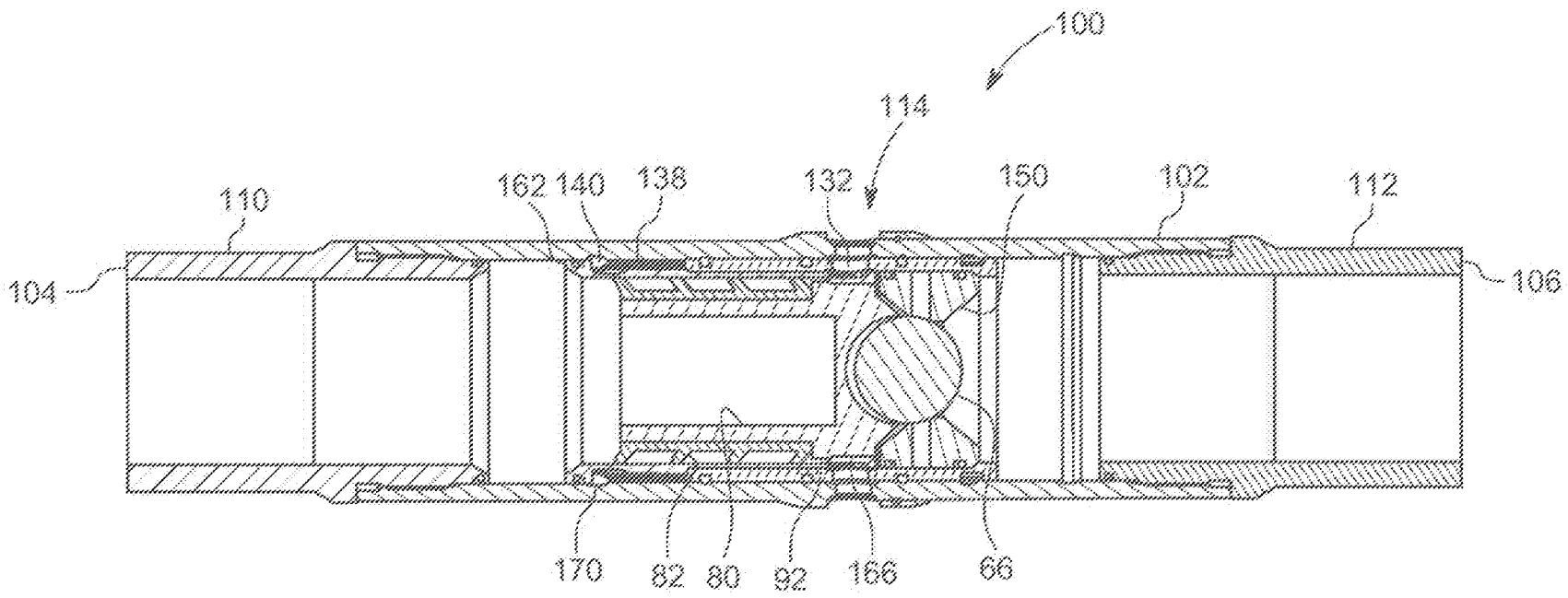
FIG. 12 is a cross sectional view of the staging tool of FIG. 7 with the dart and release sleeve shifted to a third configuration.
Figure 13:
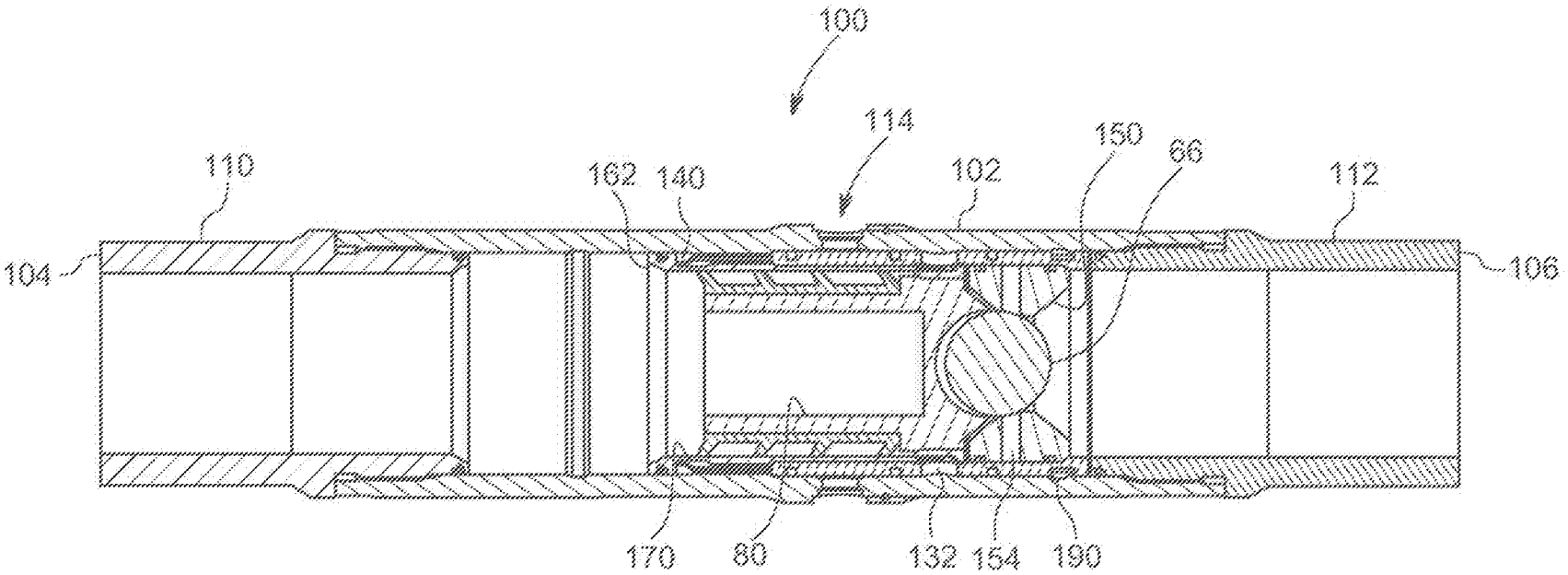
FIG. 13 is a cross sectional view of the staging tool of FIG. 7 at a closed or fourth configuration.

Once concrete pumping has completed, the dart 80 may be pumped down the interior passage 108 until the shoulder engaging surface 94 of the dart 80 engage upon the annular shoulder 166 of the release sleeve 160. Thereafter, the pressure within the central passage 108 may again be raised until a sufficient pressure is achieved to displace the release sleeve 160 either by overcoming the friction holding it in place or shearing shear pins, rings or other frangible release devices provided to retain it at the initial position. As illustrated in FIG. 12, once the release sleeve 160 is shifted towards the second end, the exterior surface 168 is moved relative to the widened end 140 of the collet arms 138 so as to locate the widened portion 140 in the radial recess 170 of the exterior surface as illustrated in FIG. 12. At such position, the exterior surface 168 no longer retains the widened portions 140 within the release recess 120 and the shifting sleeve 130 may also then be displaced towards the second end 106 so as to misalign the openings 132 with the radial bores 114 thereby closing the apparatus as illustrated in FIG. 13. Optionally, the shifting sleeve 130, may include a snap ring 190 adapted to engage within the retaining recess 122 so as to retain the shifting sleeve in the closed position. As illustrated in FIGS. 12 and 13, the dart may closely match of the shape of the ball seat and the ball to ensure that a minimal amount of concrete remains therebetween while any extra concrete is pushed out through the openings 132 and 114.

As set out above, the apparatus 100 has been resealed by the dart and shifting sleeve 130 the dart 80, wiper 82, ball seat 150 and ball 66 may be removed from the central passage 28 by any known means. In particular, known techniques such as milling may be utilized. Furthermore, as set out above, the ball 66, ball seat 150, dart 80, wiper and optionally the annular shoulder 166 may be formed of a dissolvable material so as to permit the pumping of a dissolving agent down the central passage 108 to dissolve the components thereby opening the central passage for production or other operations.

Figure 14:
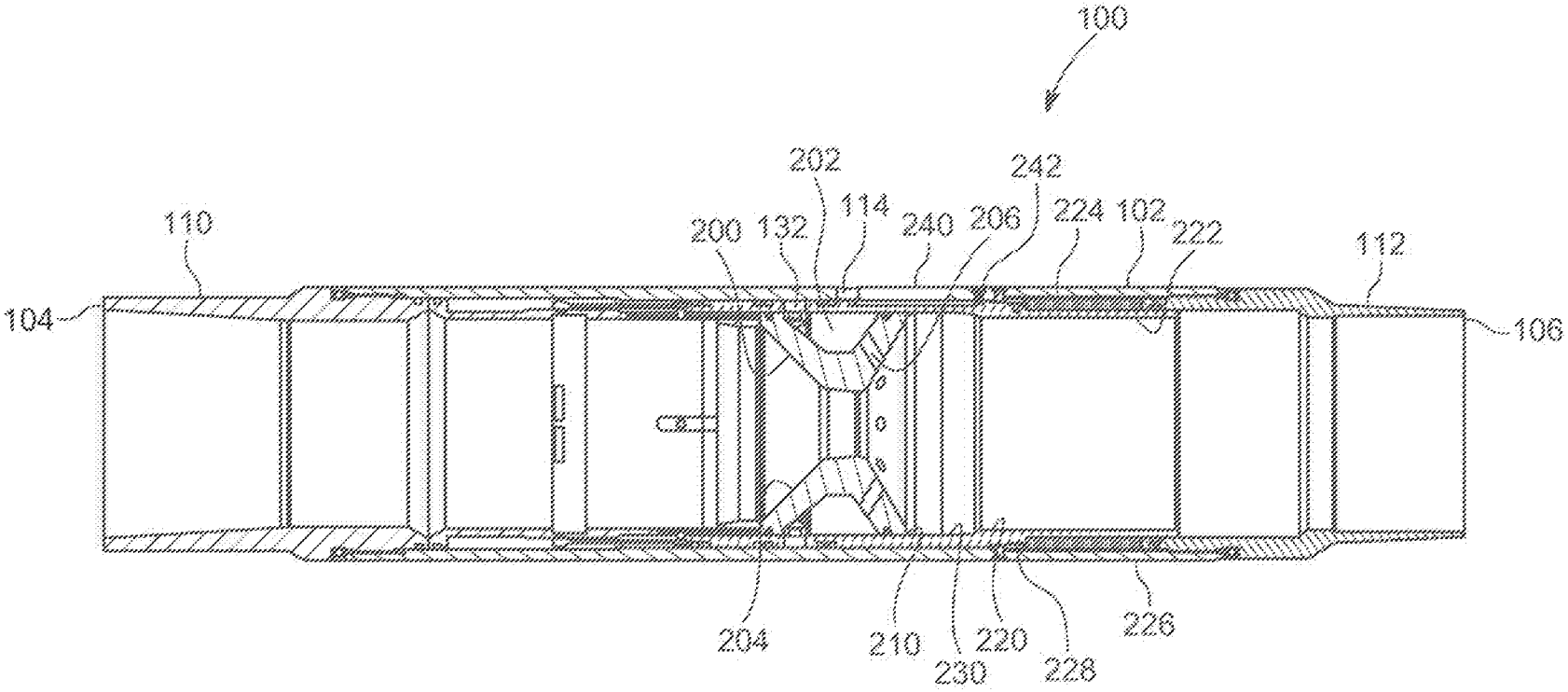
FIG. 14 is a cross sectional view of a staging tool for use in the hydrocarbon well of FIG. 1 according to a further embodiment of the present disclosure at a first or run in configuration.
Figure 15:
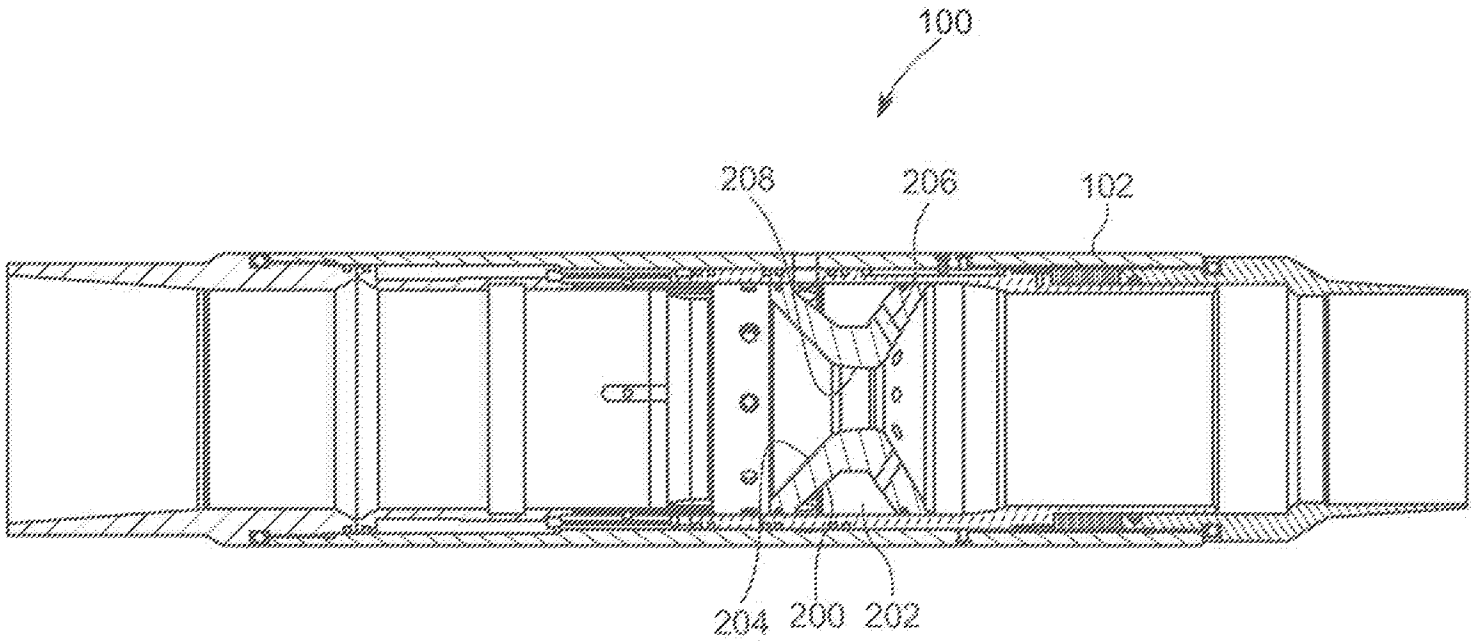
FIG. 15 is a cross sectional view of the staging tool of FIG. 14 at a second position.
Figure 16:
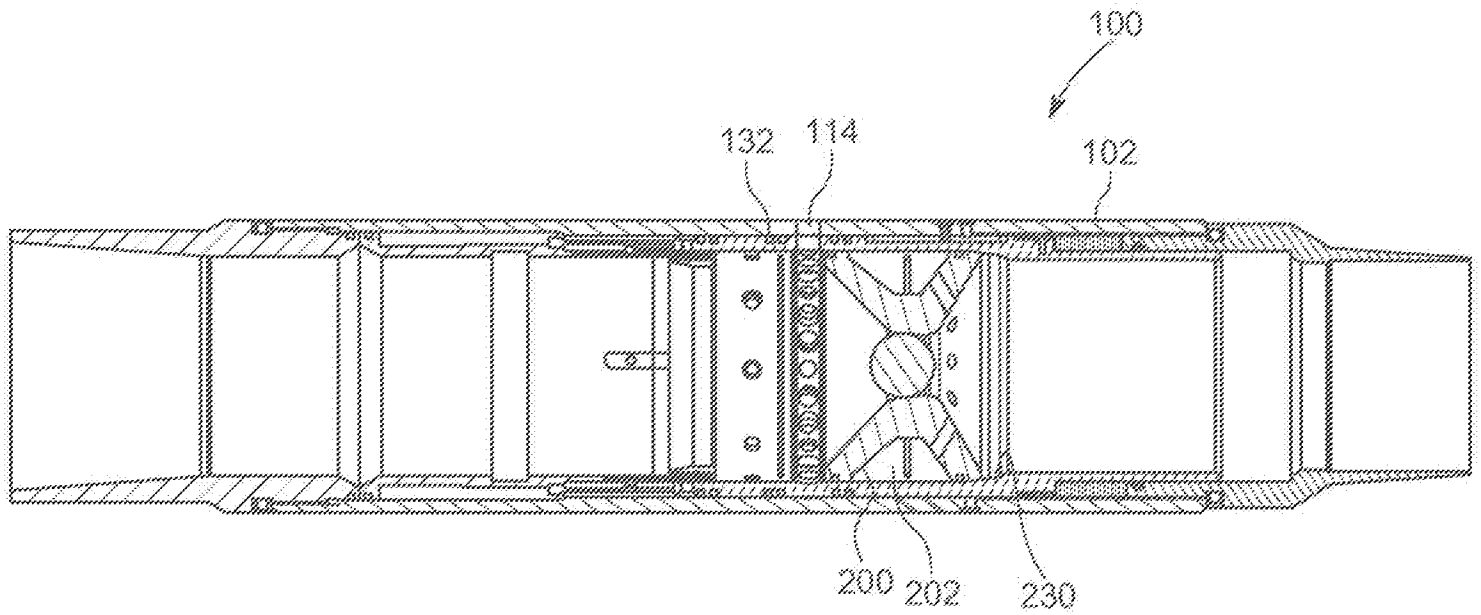
FIG. 16 is a cross sectional view of the stating tool of FIG. 14 at a third position.

Turning now to FIGS. 14-16, a further embodiment is illustrated. In particular, in some embodiments, the ball seat 200 may include an annular cavity 202 around the outer surface thereof so as to provide a substantially even thickness of a wall 204 for the ball seat 200. Such substantially even ball seat wall 204 will enable the use of less material thereby allowing the all seat to dissolve quicker and more evenly. Furthermore, the shifting sleeve 220 may have a bottom portion 222 having a diameter offset to the inside of the remainder thereof. The bottom portion may include annular teeth or ridges 226 therearound wherein the inside wall of the outer casing 102 similarly includes interior annular teeth or ridges 204. An indexing ring 228 may located therebetween having teeth corresponding to ridges 224 and 226. In operation, each of the teeth or ridges may be angularly oriented to permit movement toward the second end 106 while preventing movement towards the top end 104 of the apparatus. Such angling will retain the shifting sleeve 220 from moving back towards the first end after being shifted downward as set out below.

The bottom portion 222 of the sifting sleeve 220 is located around an interior step in the outer casing 102 such that it is offset inwardly. Such an interior radial offset creates a difference between the surface area of the shifting sleeve located towards the first end 104 as compared to the end facing the second end 106. Therefore under pressure within the central bore 108, the shifting sleeve 220 will be displaced downward upon overcoming the rupture pressure of one or more shear pins or the like. The interior surface of the shifting sleeve also includes a tapered portion 230 oriented towards the ball seat 200. The tapered portion 230 reduces the radius of the central passage 108 at that location so as to compress the ball seat 200 as it is forced thereinto. Such compression will lock the ball seat 200 within the tapered portion thereby preventing movement of the ball seat 200 back towards the first end 104 as well as preventing rotation therebetween.

Figure 17:
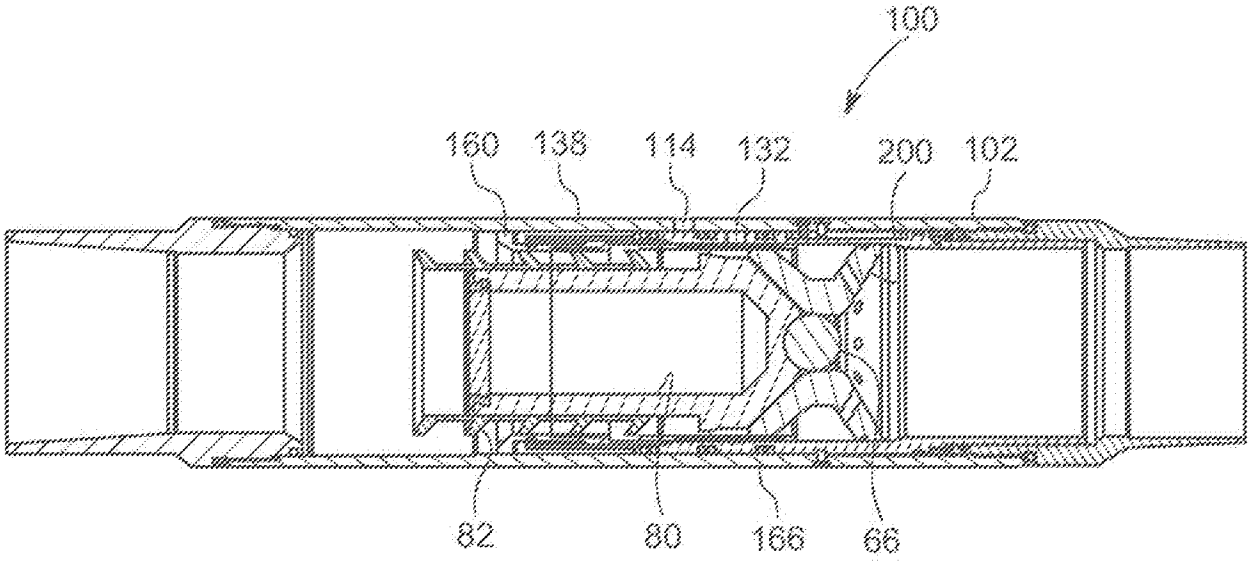
FIG. 17 is a cross sectional view of the stating tool of FIG. 14 at a fourth or closed position.
Figure 21:
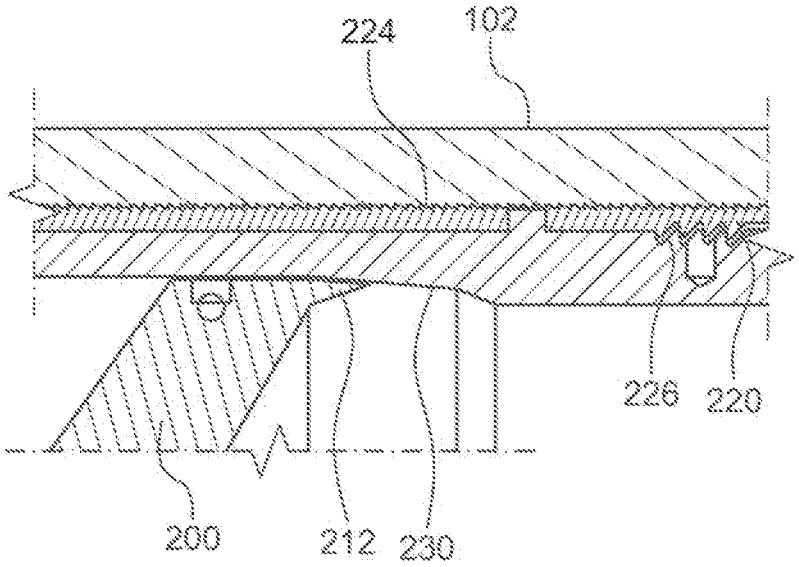
FIG. 21 is a detailed perspective view of the ball seat of FIG. 14 engaged with an deformed by the sliding sleeve.

In operation, when the apparatus is desired to be opened, the pressure within the central bore 108 may be increased to provide a pressure to the cavity 202 and the openings 132 and the tapered portion as well as the bottom end of the shifting sleeve. Due to the surface area differential between the top end and the bottom end of the shifting sleeve 220, the shifting sleeve 220 will be displaced towards the second and 106 upon reaching a sufficient pressure thereby aligning the opening 132 with the radial bores 114 as illustrated in FIG. 15. As illustrated, bores 206 may extend between the central bore 108 and the cavity at any location which is at or below the ball seat surface 208. In such position, fluids may then be passed from the central bore 108 to the annulus around the apparatus through the bores 206, openings 132 and radial bores 114. As set out above, when concrete is desired to be pumped through that zone, a ball 66 may be dropped onto the ball seat surface 208 to seal the passage at that location. Further pressure increase will then cause the ball seat to be displaced towards the second end as illustrated in FIG. 16 thereby uncovering the openings 132 and radial bores 114 to permit concrete to pass therethrough. As illustrated in FIG. 16, and in further detail in FIG. 21, the ball seat may include a tapered end foot portion 212. The end foot portion 212 has a cylindrical outer surface and a tapering inner surface. As illustrated in FIG. 21, when the foot portion 212 encounters the tapered portion 230 on the shifting sleeve 220, the foot portion will be compressed inwardly and may optionally deform as illustrated. Such deformation and compression will form a frictional engagement therebetween thereby preventing longitudinal and rotational movement therebetween. As set out above, when concrete operations are completed, a dart 80 may be dropped so as to engage an annular shoulder 166 on a release sleeve 160. Thereafter movement of the release sleeve 160 permits inward movement of widened portions 140 on the end of collet arms 138 thereby permitting the shifting sleeve 220 and ball seat 200 to also be shifted to close the radial bores 114 as illustrated in FIG. 17 at the final closed position.

The shifting sleeve 220 may also include one or more slots 1240 formed longitudinally therearound. Bolts, pins or the like 242 may extend from the outer casing 102 to be located therein. Such bolts will prevent rotation of the shifting sleeve 220 should milling me required to remove any components thereof. It will also be appreciated that other anti-rotation means may also be utilized such as longitudinal ridges, cross-sectional profiles or the like to prevent rotation between the outer casing 102 and the shifting sleeve 220.

Figure 18:
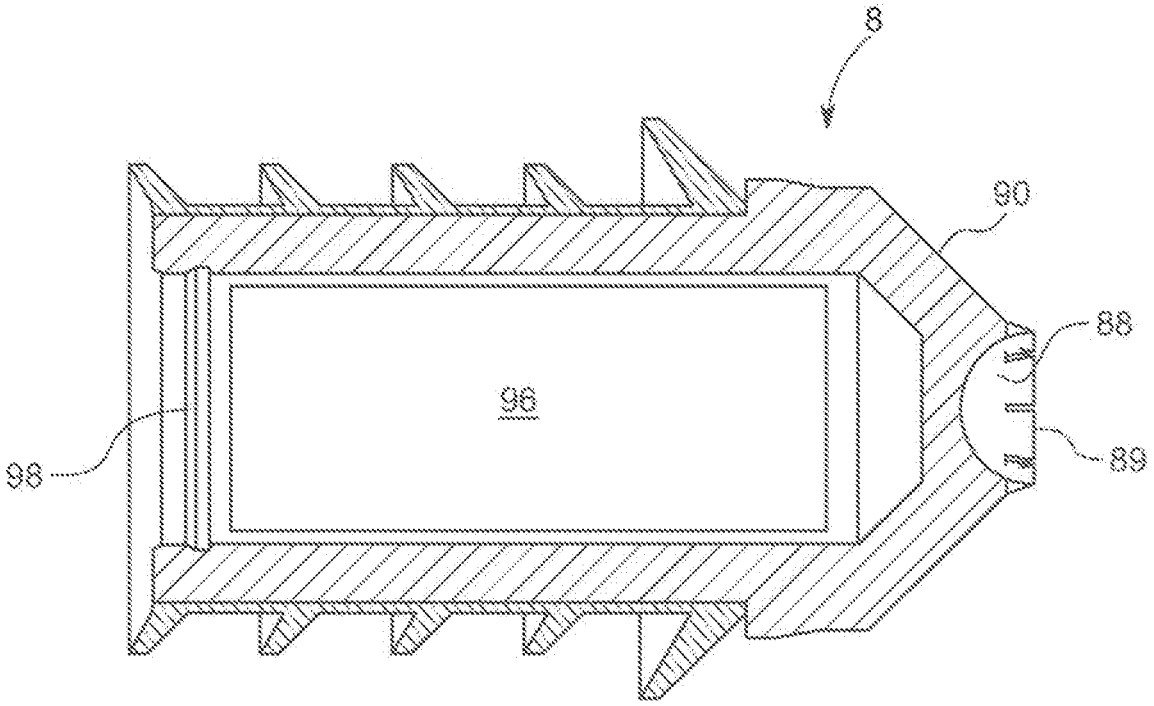
FIG. 18 is a cross sectional view of a dart according to a further embodiment.
Figure 19:
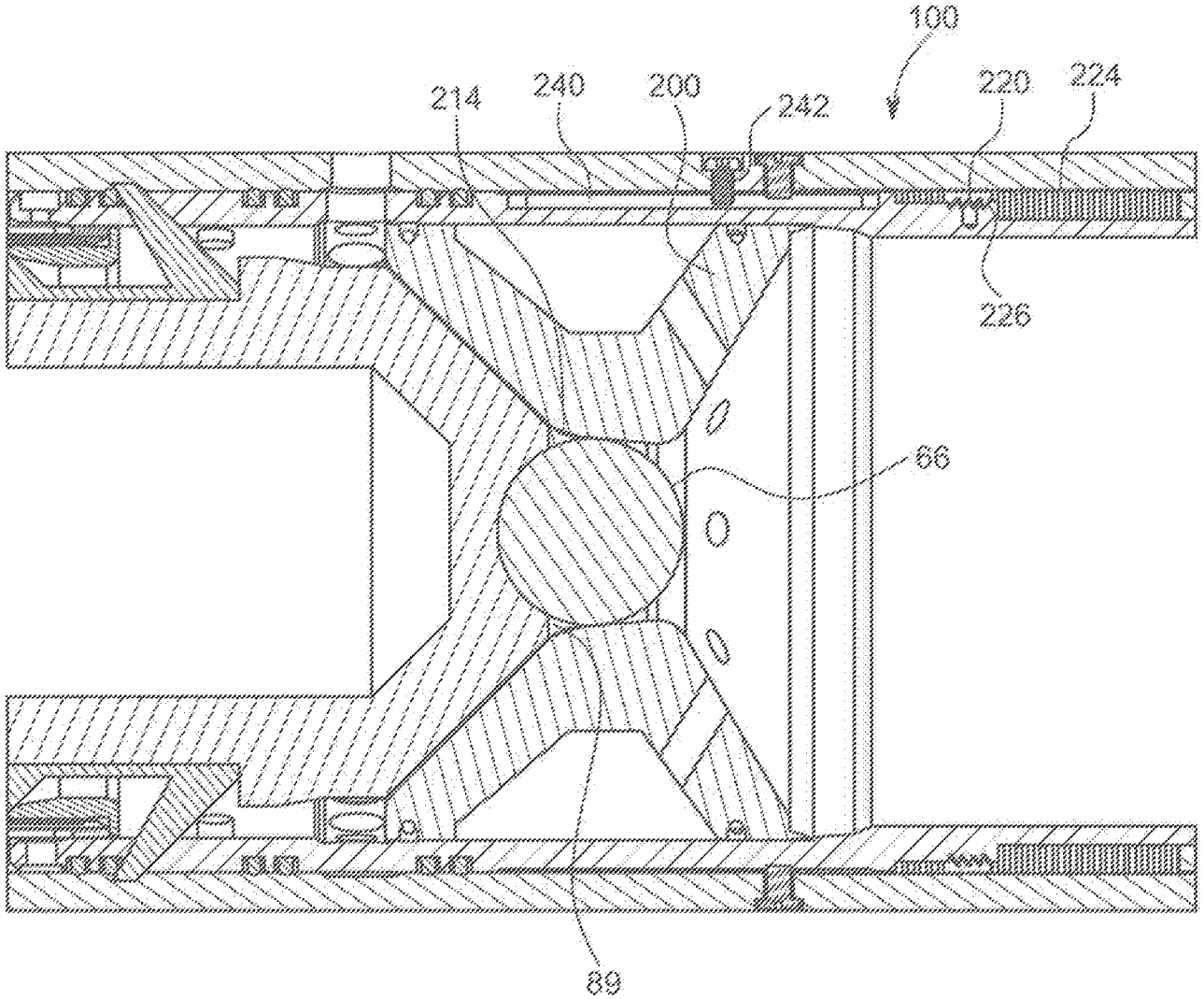
FIG. 19 is a detailed cross sectional view of the dart of FIG. 18 engaged with a ball and ball seat.

Optionally, as illustrated in FIG. 18, the dart 80 may include at least one deformable tip 89 extending longitudinally between the spherical recess 88 and the tapered portion 90. The deformable tip is selected to be substantially similar to the outer surface of the ball 66 and a radiused entrance 214 to the ball seat surface 208. In particular the tips 89 may have a substantial taper so as to be operable to be wedged between the ball sat 200 and the ball 66 thereby locking the dart 80 to the ball seat 200 and ball and preventing rotation therebetween. Optionally, as illustrated in FIG. 18, the dart 80 may include within an interior cavity, a quantity of a dissolving agent 96 as are known. In particular, the dissolving agent 96 may be a salt of an aqueous dissolving fluid wherein the fluid is introduced to the fluid when the dissolvable components are desired to be dissolved. In particular, the salt 96 may be contained within a container that is also dissolvable by the solvent for the fluids. By way of non limiting example an aqueous based dissolving fluid may be stored therein within a water soluble container such that the introduction of water to the well bore dissolves the container forming the dissolving fluid for dissolving the remaining components. A plug 98 may also be located in the dart 80 to seal the salt 96 therein which may also be fluid soluble or degradable. Optionally, the plug 98 may permit a selected amount of fluid to leak therepast so as to provide a time delay to the dissolving.

Figure 20:
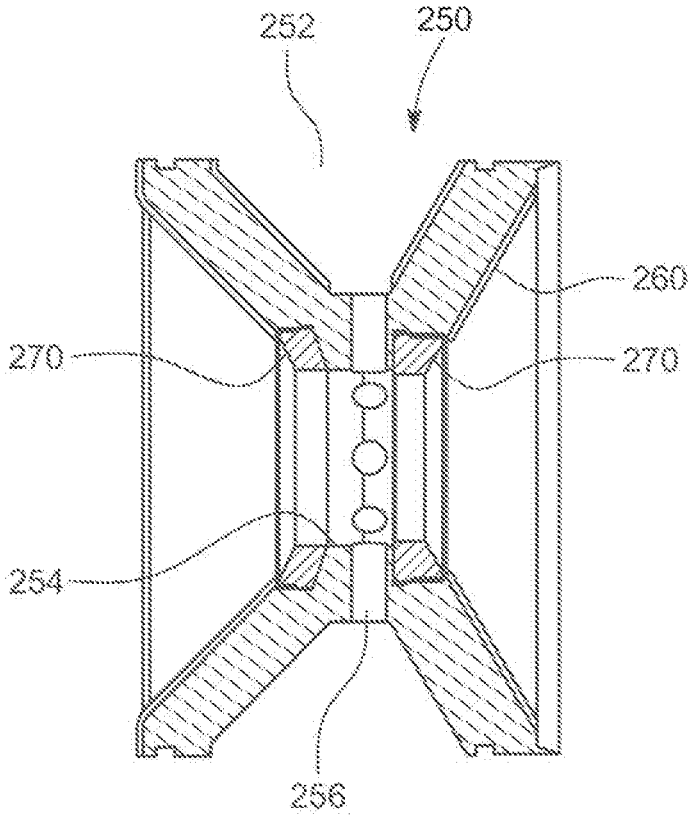
FIG. 20 is a detailed cross sectional view of a ball seat for use in an apparatus according to the present disclosure.

Turning now to FIG. 20, a further embodiment of a ball seat 250 is illustrated. IN particular the ball seat 250 includes a cavity 252 therearound as set out above and passages 256 extending between a ball seat surface 254 and the cavity. The ball seat 250 may furthermore include a coating layer 260 thereover that has a reduced dissolving rate than the material selected for the ball seat itself. In such a way the coating layer 260 may delay the dissolving of the ball seat 250 until the coating layer has also been dissolved. Optionally, the coating layer 260 may be formed to be thinner or non-existent on one or more location of the ball seat 250, such as by way of non-limiting example on the inside surface of the cavity as illustrated, so that any dissolving of the ball seat will begin at that desired location. Optionally, the ball seat 250 or any other ball seat may include abradable cover bodies 270 over one or more of the entrance, exit from or the ball seat surface itself. The cover bodies 270 may be formed of a material selected to be abraded by the flow of fluid therepast such as drilling fluid which may include solid particles entrained therein and may be soft enough to be compressed or displaced by a ball 66 dropped into place. Such cover bodies 270 will protect the ball seat surface 254 itself from being thus abraded by being eroded in it's place.

While specific embodiments have been described and illustrated, such embodiments should be considered illustrative only and not as limiting the disclosure as construed in accordance with the accompanying claims.

What is claimed is:

1. An apparatus for selectively opening a passage through a downhole casing comprising:

an elongate cylindrical housing defining a central bore therein and having at least one passage extending therethrough between the central bore and an exterior of the housing, the housing being configured to be located in line within a downhole casing;

a ball seat slidably located within the central bore so as to be operable to selectively cover or uncover the at least one passage; and a sealing sleeve slidably located within the central bore between an open and closed position wherein the sealing sleeve covers the at least one passage in the closed position and uncovers the at least one passage in the open position, wherein the ball seat is configured to be translatable to an open position within the housing independent of the sealing sleeve and with the sealing sleeve to the sealing sleeve closed position.

2. The apparatus of claim 1 further comprising an intermediate sleeve adapted to cover the at least one passage at a run in configuration.

3. The apparatus of claim 2 wherein the open position of the sealing sleeve is upstream of the closed position.

4. The apparatus of claim 2 wherein the sealing sleeve includes at least one collet arm extending upwardly therefrom.

5. The apparatus of claim 1 wherein the ball seat is connected to and operable to displace the sealing sleeve.

6. The apparatus of claim 1 wherein the sealing sleeve includes a shoulder adapted to receive a dart thereon.

7. The apparatus of claim 6 wherein the displacement of the sealing sleeve with the dart moves the sealing sleeve from the open position to the closed position.

8. The apparatus of claim 1 wherein the ball seat is slidable to uncover a transfer passage through the sealing sleeve.

9. The apparatus of claim 1 further comprising a release sleeve adapted to retain the sealing sleeve at an open position.

10. The apparatus of claim 9 wherein the release sleeve includes a shoulder adapted to receive a dart thereon.

11. The apparatus of claim 10 wherein the displacement of the release sleeve disengages at least one collet arm on the sealing sleeve permitting movement of the sealing sleeve from the open position to the closed position.

12. The apparatus of claim 10 wherein the dart is formed of a dissolvable material.

13. The apparatus of claim 1 wherein the ball and the ball seat are formed of a dissolvable material.

* * * * *